United States Patent [19]

Hayakawa et al.

[11] Patent Number: 5,011,510

[45] Date of Patent: Apr. 30, 1991

[54] COMPOSITE ABRASIVE-ARTICLES AND MANUFACTURING METHOD THEREFOR

[75] Inventors: Izumi Hayakawa, Kamakura; Hiroshi Soboi, Tama, both of Japan

[73] Assignee: Mitsui Mining & Smelting Co., Ltd., Tokyo, Japan

[21] Appl. No.: 410,591

[22] Filed: Sep. 21, 1989

[30] Foreign Application Priority Data

Oct. 5, 1988 [JP] Japan ..... 63-252252

[51] Int. Cl.[5] ..... B24D 3/00

[52] U.S. Cl. ..... 51/293; 51/307; 51/309

[58] Field of Search ..... 51/293, 309, 307

[56] References Cited

U.S. PATENT DOCUMENTS

| | | | |
|---|---|---|---|
| 3,955,324 | 5/1976 | Lindstrom | 51/298 |
| 4,246,006 | 1/1981 | Phaal | 51/309 |
| 4,278,448 | 7/1981 | Ishizuka et al. | 51/309 |
| 4,362,535 | 12/1982 | Isobe et al. | 51/293 |
| 4,373,934 | 2/1983 | Hayden | 51/309 |
| 4,399,167 | 8/1983 | Pipkin | 51/309 |
| 4,591,363 | 5/1986 | Silverman | 51/293 |
| 4,591,364 | 5/1986 | Phaal | 51/309 |
| 4,618,349 | 10/1986 | Hashimoto et al. | 51/309 |

FOREIGN PATENT DOCUMENTS 60-3557 1/1985 Japan .

*Primary Examiner*—William R. Dixon, Jr.
*Assistant Examiner*—Willie J. Thompson
*Attorney, Agent, or Firm*—Flynn, Thiel, Boutell & Tanis

[57] ABSTRACT

A composite abrasive-articles according to the present invention is obtained by: mixing diamond pieces of abrasive articles or cubic boron nitride pieces of abrasive articles and metal powder, molding this mixture into a uniformed small piece of abrasive articles, then or simultaneously with this molding, completely sintering the uniform small piece of abrasive articles after the molding, and mixing the completely sintered piece of abrasive articles after the sintering with resin, metal or glass of a low melting point so as to be solidified into a predetermined shape. In the composite abrasive-article of this type, the completely sintered piece of abrasion articles made of the diamond pieces of abrasion articles or cubic boron nitride piece of abrasive articles and metal powder is dispersed and solidified in a matrix made of either resin, metal, or glass having a low melting point. The composite abrasive-articles are preferably used for grinding, polishing, and/or cutting metal, ceramics, stone, or the like.

7 Claims, 1 Drawing Sheet

COMPOSITE ABRASIVE-ARTICLES AND MANUFACTURING METHOD THEREFOR

BACKGROUND OF THE INVENTION

1. Field of the Invention

The present invention relates to composite abrasive-articles and a manufacturing method therefor exhibiting high efficiency and long life, the composite abrasive-articles being used for grinding, polishing, and cutting metal, ceramics, stone, or the like.

2. Description of the Prior Art

In general, composite abrasive-articles are used for grinding, polishing, and cutting metal, ceramics, stone, or the like, the composite abrasive-articles being manufactured by dispersing and solidifying a piece of abrasive article consisting of diamond abrasive or cubic boron nitride abrasive and metal powder in a matrix made of resin, metal, or glass of a low melting point.

A conventional method of manufacturing composite abrasive-articles has been disclosed in Japanese Patent Laid-Open No. 50-153387, and another conventional method has been disclosed in Japanese Patent Publication No. 60-3557.

According to these inventions, a sintered body of abrasive and metal powder is pulverized in the manufacturing process so as to be small chips, the thus-obtained small chips being then dispersed and solidified in resin or the like.

In particular, according to the invention disclosed in Japanese Patent Publication No. 60-3557, abrasive and metal powder are incompletely sintered so as to be readily pulverized in the latter manufacturing process. The powder is then screened for the adjustment of the particle size thereof. It then dispersed in resin or metal before being subjected to heat molding so that it is completely sintered.

According to the above-described conventional invention, since massive and pulverized abrasive article pieces are formed by way of the pulverization performed in the manufacturing process after the sintering (the incomplete sintering), it is difficult to employ metal of the type displaying a high malleability and ductility as the metal which forms the abrasive article. Therefore, metal which can be readily pulverized, that is, brittle metal is necessarily employed. According to the invention disclosed in Japanese Patent Laid-Open No. 50-153387, since no particle-size adjustment is conducted, a problem of non-uniform abrasion and surface roughness of the ground surface arises due to the non-uniform distribution of the particle size in the produced abrasive-article obtained after the manufacturing process. Furthermore, according to the invention disclosed in Japanese Patent Publication No. 60-3557, the particle size adjustment of the abrasive which has been pulverized after the incomplete sintering is conducted, the particle size adjustment being conducted by means of a screen. However, the portion separated by the screening raises the cost, and the shape of the screened pieces of the abrasive articles cannot be made to be uniform in terms of the shape thereof. Furthermore, the particle size distribution ranges excessively widely. Therefore, the abrasive-article of the type described above encounters a problem of a difficulty of controlling the grinding ratio, cutting capability, and life thereof.

SUMMARY OF THE INVENTION

An object of the present invention is to provide composite abrasive-articles and a manufacturing method therefor from which the pulverization process which is arranged to be conducted after the sintering process can be eliminated for the purpose of raising the manufacturing yield whereby a piece of abrasive article exhibiting uniform shape and extremely narrow particle size distribution can be obtained. The thus-obtained piece of the abrasive article being able to form the composite abrasive-article, the grinding ratio and the life of which can be optionally controlled to correspond to the type of the substance to be ground (both substance to be polished and substance to be cut are included) and which exhibits an excellent grinding ratio and reduced grinding resistance.

The method of manufacturing composite abrasive-articles according to the present invention comprises the following steps of:

mixing diamond pieces of abrasive articles or cubic boron nitride pieces of abrasive articles and metal powder;

molding the mixture into a uniform small piece of abrasive articles;

then, or simultaneously with the molding, completely sintering the uniform small piece of abrasive articles which has been molded; and mixing a completely sintered piece of abrasive articles and any of resin, metal, or glass having a low melting point, whereby the mixture is solidified into a predetermined shape.

The composite abrasive-articles obtained as described above are formed by way of dispersing and solidifying a completely sintered and uniform abrasive consisting of diamond abrasive or cubic boron nitride abrasive and metal powder in a matrix of resin, metal, or glass having a low melting point.

The other objects and constructions will be clear from the following explanations.

BRIEF DESCRIPTION OF THE DRAWINGS

The accompanying drawing is a photograph which illustrates the structure an abrasive on the surface of a composite abrasive-article according to the present invention enlarged by 20 times.

DETAILED DESCRIPTION OF THE INVENTION

Figure 1:
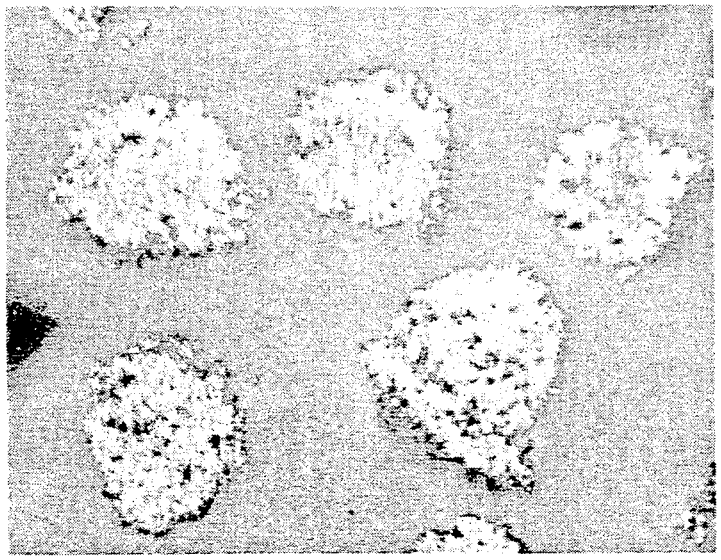

The present invention will be explained in more detail hereinafter.

According to the present invention, the term "uniform small piece of abrasive article" means a substance formed by mixed powders of diamond abrasive or cubic boron nitride abrasive and metal powder or paste prepared as a result of the kneading with a caking instrument, the uniform small piece of abrasive article being formed by a uniform non-sintered body having a constant shape without dimensional distribution.

The metal powder according to the present invention is exemplified by a sole metal powder of copper, iron, nickel, or the like, a variety of alloy powders, and mixed powder of metals. Furthermore, powders of metals displaying malleability and ductility may be employed. In particular, it is preferable to employ Ni-Cu-Sn, Ni-Cu-Sn-P, Ni-Zn, Cu-Sn, and Cu-Su-Zn.

The metal powder of the type described above and the diamond abrasive or cubic boron nitride (CBN) are mixed and are then molded. The molding is conducted in accordance with the screen printing method, perforated screen method, metal molding method, molding method, hot pressing method. Granulation method so that the uniform small piece of abrasive articles is formed.

Then, a specific example of the molding method will be described.

In the screen printing method and aperture plate printing method, a paste of a kneaded body obtained by kneading the above-described mixed powder and a caking aid such as polyvinyl alcohol is printed on a base such as a graphite plate or a ceramic plate that can withstand the sintering temperature, the base being formed on a plate having a predetermined pattern. As a result, the uniform small piece of abrasive articles can be formed.

The metal molding method is arranged such that: a metal die and a punch are used and the mixed powder is enclosed in the die. Then, the thus-enclosed mixed powder is pressed by the punch so as to be solidified. As a result, a desired uniform small piece of abrasive articles is formed.

The hot pressing method is arranged such that: a graphite die and a punch are used, and the mixed powder is enclosed in the die. Then, electricity is supplied to the graphite die with pressure applied with the punch. Alternatively, a metal die including a heater and a punch is used, and the mixed powder is enclosed in the die. Then, the heater is actuated with a pressure applied by the punch so as to solidify the mixed powder. As a result, a completely sintered small piece of abrasive articles is formed.

The molding method is arranged such that: a mold having a predetermined shape is formed on the base such as a ceramic plate which can withstand the sintering temperature, the mold being formed by drilling or supersonic machining. Then, the above-described mixed powder is enclosed in the thus-formed mold, causing the uniform small piece of abrasive articles to be formed.

The granulating method is arranged such that: the above-described mixed powder and liquid paraffin diluted and adjusted by, for example, an organic solvent, are kneaded and the thus-kneaded material is granulated to a predetermined shape by a commercially available granulating machine. As a result, the uniform small piece of abrasive articles is formed.

The uniform small piece of abrasive articles may, of course, be prepared by any conventional method so far as the non-uniform distribution of the particle size can be prevented. For example, it may be prepared by means of a controlled atomization.

The obtained uniform small piece of abrasive articles is then subjected to the sintering process. The sintering is conducted such that the uniform small piece of abrasive articles is completely sintered in an non-oxidized atmosphere such as hydrogen, ammonia cracked gas at a temperature above 500° C. As a result, the completely sintered small piece of abrasive articles is formed. When the uniform small piece of abrasive articles is formed by the hot pressing method, the sintering process can be eliminated since the complete sintering is conducted simultaneously with the molding.

Then, the thus-obtained completely sintered small piece of abrasive articles and the material for the matrix are mixed so as to meet the purpose, the matrix material being exemplified by a resin such as a phenol resin and epoxy resin, all known types of metal that can be used for a usual metal bond abrasive article, and glass having a low melting point. This mixed material is then heated, hardened at room temperature, or molded by pressure so as to be molded into the shape of the abrasive article. As a result, the abrasive article is formed. A grinding aid may be added to the matrix, the grinding aid being exemplified by: diamond, CBN, SiC, alumina, fillers which are usually added to the resin bond abrasive articles such as calcium carbonate, and talc, and a solid lubricant (molybdenum disulfide, boron nitride, carbon, or the like).

The thus-obtained composite abrasive-articles made of resin bond, metal bond, or vitrified bond are further composed by way of dispersing uniform small piece of abrasive articles which has been completely sintered and which displays no particle size distribution in the matrix thereof, the uniform small piece of abrasive articles being made of diamond abrasive-articles or cubic boron nitride abrasive and metal powder. That is, the completely sintered and uniform abrasive-articles are dispersed, the completely sintered and uniform abrasive-articles having extremely reduced particle size.

The uniform small piece of abrasive-articles precomplete sintering, which is used for the composite abrasive-articles according to the present invention, is a piece of abrasive-article having a uniform diameter involving extremely reduced particle size distribution. Therefore, the completely sintered small piece of abrasive-articles obtained by completely sintering the former also displays the uniform diameter, it is then dispersed and solidified in the matrix. Therefore, the particle size of the piece of the abrasive-articles and the weight ratio of the same can be optionally arranged to meet the various way of usage of it.

In order to realize a further uniform particle size of the completely sintered piece of abrasive-articles, it is preferable that the uniform small piece of abrasive-articles is formed by the screen printing method, perforated screen printing method, metal molding method, hot pressing method, or molding method.

The accompanying drawing is a microphotograph of an enlargement of 20 times of an embodiment of the composite abrasive-articles according to the present invention, the composite abrasive-articles being obtained by forming a completely sintered piece of abrasive articles by using a uniform small piece of abrasive articles manufactured by the perforated screen printing method and by mixing it with resin before being enclosed into a predetermined mold.

The completely sintered piece of abrasive-articles according to the present invention is arranged to be a uniformed cylindrical or disc like body having a size range of between $\phi 0.1 \times 0.1$ and $\phi 5 \times 5$ mm, preferably a range of between $\phi 0.5 \times 0.5$ and $\phi 3 \times 3$ mm in the case where it is molded by the screen printing method, perforated screen printed method, metal molding method, hot pressing method, or the molding method. On the other hand, in the case where the completely sintered piece of abrasive-articles is formed in accordance with the granulating method, it is arranged to be a spheric body having a size range between $\phi 0.1$ to $\phi 5$ mm, preferably range between $\phi 0.3$ to $\phi 3$ mm.

Although the composite abrasive-articles shown in FIG. 1 use the completely sintered piece of abrasive-articles having the same size, another type of composite abrasive-articles may be employed, this composite abrasive-articles being formed such that two types of small pieces of abrasive articles, each type having individual particles sizes are dispersed and solidified in the matrix. According to this method, a further improved grinding performance can be obtained since the relatively large pieces of abrasive articles and relatively small pieces of abrasive articles can be dispersed in the matrix with a satisfactory balance arranged.

Then, embodiments will be described.

Embodiment 1

60 parts of metal powder consisting of 15 wt % tin and a balance of copper and 40 parts of diamond powder having a mean particle size of 120μ were mixed, and then a solution obtained by dissolving PVB in an organic solvent was added so that a paste whose viscosity had been adjusted to be preferable for the printing was prepared. Then, a screen with perforations of $\phi 1.3 \times 0.4$ t was disposed on a graphite plate having the thickness of 3 mm, then the above-described paste was printed by using a squeegee. As a result, a uniform small piece of abrasive articles of $\phi 1.3 \times 0.4$ t was obtained. The thus-obtained uniform small piece of abrasive articles was completely sintered with the graphite plate at 750° C. for one hour in a hydrogen atmosphere. As a result, a planing resin-bonded abrasive-articles was manufactured from 30 parts of $\phi 1 \times 0.3$ t completely sintered piece of abrasive articles with extremely reduced particle size distribution, 38 parts of diamond powder having an average particle size of 120μ, and a balance of phenol resin. Another planing resin bond abrasive-article of $\phi 205 \times 10$ w$\times$3 t consisting of 50 parts of diamond powder having a particle size of 120μ and a balance of phenol resin was manufactured so as to be subjected to a comparison made with the planing resin bond abrasive-articles according to the present invention.

These abrasive-articles were mounted on a reciprocating type grinder (PSG52DX) manufactured by Okamoto Machine Co., Ltd and a 99% alumina (200 mm$\times$200 mm$\times$10 mmt) plate was ground under the following conditions, the result being shown in Table 1:

| Conditions | |
|---|---|
| Wheel Speed | 3000 rpm |
| Table Speed | 10 m/min |
| Cross Feed | 3 mm |
| Downfeed | 20 μm/pass |
| Coolant | soluble type diluted by 40 times |

TABLE 1

| | Present Invention | Comparative Example |
|---|---|---|
| Grinding Ratio | 625 cc/cc | 284 cc/cc |
| Grinding Resistance | 13.5 kgf | 17 kgf |

Embodiment 2

A mixture of 80 parts of metal powder consisting of 10 wt % tin, 17 wt % copper, 0.5 wt % phosphorus, and a balance of nickel and 20 parts of diamond powder having an average particle size of 45 μm and 5%-water solution of PVA were mixed. Then, the thus-obtained mixture was introduced into to a commercially available granulating machine so that an $\phi 1.1$ mm spheric uniform small piece of abrasive articles was obtained. It was then completely sintered at 900° C. for one hour in ammonia cracked gas.

As a result, chips of abrasive-articles of 20 w$\times$30L$\times$10 t were obtained from 40 parts of completely sintered piece of abrasive articles of $\phi 0.8$ mm obtained, 10 parts of calcium carbonate, and a balance of epoxy resin. The 15 chips were fixed to a bakelite plate in such a manner that 12 chips were fixed to the outermost circumferential direction and 3 chips were fixed to the inner portion so as to grind the surface of granite. In order to make a comparison, comparative examples A and B of 500 U.S. mesh manufactured by the other manufacturer were subjected to the similar surface grinding.

An Isobe Stone grinder was used to grind 300 mm$\times$300mm+10 mmt granite at a wheel speed of 500 rpm for 2 minutes with water used for cooling. The results are shown in Table 2.

TABLE 2

| | present Invention | Comparative Example A | Comparative Example B |
|---|---|---|---|
| Stock removal | 202 g | 147 g | 110 g |

As is shown from Table 2, the present invention displays an improvement in the grinding performance by 30% or more with respect to comparative example A, and by 95% with respect to comparative example B.

Embodiment 3

90 wt % metal powder containing of 10 wt % tin and a balance of nickel and 10 wt % diamond powder having a particle size of 170 U.S. mesh were mixed. Then, a perforated screen $\phi 0.2 \times 1.5$ t in which a perforation was formed was placed on a graphite plate, this perforation being then filled with the above-described mixed powder. Then, the perforated screen plate was removed after it has been enclosed in this perforation, resulting in a uniform small piece of abrasive articles. The thus-obtained uniform small piece of abrasive articles was completely sintered with the graphite plate at 850° C. for 1 hours in ammonia cracked gas. The thus-obtained 50 parts of completely sintered piece of abrasive articles of $\phi 1.5 \times 1.0$ t, 30 parts of silicon carbide which serves as an aggregate, and balance of boro-silicated glass were molded to form a body of outer diameter of 205 mm, inner diameter of 199 mm, and height of 10 mm so as to be sintered in air at 800° C. The thus-obtained sintered body was adhered by an adhesive to an aluminum plate of outer diameter of 198 mm$\times$10 mm so that a vitrified bond grinding wheel containing completely sintered piece of abrasive articles was obtained. In order to make a comparison, a vitrified bond diamond abrasive-articles having the same composition but containing no completely-sintered piece of abrasive articles having the grain size of diamond of 170 U.S. mesh and a concentration of 75 (concentration of 100=4.4 cts/1 cc of abrasive-articles) was subjected to a test. The test was conducted by using a grinder similar to that employed in Embodiment 1 and ground under the same conditions as those for Embodiment 1. The results are shown in Table 3. As is shown from Table 3, the abrasive-articles according to the present invention displays an increase in grinding ratio (the value of ground work/value of reduction of the abrasive-articles) by 73%.

TABLE 3

| | Present Invention | Comparative Example |
|---|---|---|
| Grinding ratio | 295 cc/cc | 170 cc/cc |

Embodiment 4

Mixed powder consisting of 3 wt % zinc, 4 wt % of 40 U.S. mesh diamond pieces of abrasive article, and a balance of nickel was molded into a uniform small pieces of abrasive articles of $\phi 1 \times 1$ t in accordance with the metal molding method. It was then completely sintered at 750° C. for 0.5 hour in hydrogen atmosphere so that a completely sintered piece of abrasive articles ($\phi 0.9 \times 0.9$ t) was obtained.

Then, 55 parts of metal mixed powder consisting of 7 wt % tin, 45 wt % copper, 0.8 wt % phosphorus, and a balance of nickel, 45 parts of the above-described completely sintered piece of abrasive articles were mixed. The thus-obtained chip of 50L×10H×2.5W and having a curvature radius of 254 mm was sintered at 650° C. for 15 minutes in air in accordance with the hot pressing method. Then, 22 chips containing the completely sintered piece of abrasive articles were fastened to the periphery of an iron plate having an outer diameter of 488 mm, at equal intervals by using silver solder so that a cut off wheel was obtained. In order to make a comparison, mixed powder consisting of 1.7 wt % zinc, 4 wt % tin, 0.4 wt % phosphorus, 25 wt % copper, 2 wt % diamond piece of abrasive articles of a particle size of 40 U.S. mesh, and a balance of nickel were prepared under the same conditions as those for the present invention by the same number. Thus, a cut off wheel of the same shape was manufactured for making a comparison.

The thus-manufactured cut off wheel was used to cut granite of 100 mm×100 mm×20 mm with a Maruto cutter MC-420 at a wheel speed of 1200 rpm with water used as a coolant. The electric power consumption was 2.4A with the cutter according to the present invention, while it was 3.8A with the comparative example.

Embodiment 5

Mixed powder consisting of 10 wt % tin, 5 wt % diamond powder having the grain size of 200 U.S. mesh, and a balance of copper was prepared. Then, this mixed powder was enclosed in a graphite plate having a multiplicity of perforations of $\phi 2 \times 1$ t. The graphite plate in which the mixed powder containing diamond was sintered in ammonia cracked gas at 700° C. for 1.5 hours. As a result, $\phi 1.4 \times 0.7$ t completely sintered piece of abrasive articles whose particle size was uniform was obtained.

Furthermore, mixed powder of a similar composition was enclosed in a graphite plate having a multiplicity of perforations of $\phi 3.5 \times 2.5$ t. Thus, completely sintered piece of abrasive articles of $\phi 2.5 \times 1.8$ was obtained from the similar manufacturing conditions to the above-described conditions.

Then, 20 chips of the abrasive-articles of 50L×5 t×5W (curvature radius 185 mm) were manufactured, the chip consisting of 30 parts of $\phi 1.4 \times 0.7$ t completely sintered piece of abrasive articles, 25 parts of f2.5×1.8 t completely sintered piece of abrasive articles, and a balance of epoxy resin. The thus-manufactured chips were fixed to an aluminum plate, in the cup shape having an outer diameter of 370 mm and inner diameter of 350 mm, at equal intervals by using an epoxy bond.

In order to make a comparison, an abrasive-articles of the same shape consisting of 13 parts of 200 U.S. mesh diamond, 8.7 parts of calcium carbonate, and a balance of epoxy resin was manufactured.

They were mounted on a vertical spindle grinding machine manufactured by Sansei Ltd. so that 99% alumina of 300 mm×300 mm×10 mmt was ground at 1500 rpm and down feed of 60 μ/min. The abrasive articles of the comparative example overheated due to the grinding work 5 minutes after the start of the grinding, causing the color of the resin bond portion to be turn red. It was impossible to use it further.

However, the abrasive-articles according to the present invention smoothly ground without no problem to 300 mm×300 mm×5 mmt' (83 minutes).

Embodiment 6

Mixed powder consisting of 10 wt % tin, 20 wt % copper, 2 wt % diamond powder having the average grain size of 12μ, and a balance of nickel was enclosed in a graphite mold in which a multiplicity of $\phi 2$ perforations are formed. Then, this mixture was pressed from above and beneath by using $\phi 2$ punches under a load of 100 kg/cm$^2$, and simultaneously electricity was supplied to the graphite mold so as to heat it at 650° C. for 15 minutes. As a result, $\phi 2 \times 2$ t uniformed and completely sintered piece of abrasive articles was obtained in accordance with the hot pressing method.

A disc-like tool of $\phi 120 \times 5$ t was manufactured by 60 parts of the obtained completely sintered piece of abrasive articles and a balance of epoxy resin. It was then adhered to a cast plate of $\phi 120$ with an epoxy bond so that a tool for polishing lens was manufactured.

In order to make a comparison, a tool of the same shape was manufactured using an epoxy resin bond containing diamond powder having an average grain size of 12μ and a concentration of 10.

Then, they were used to smooth $\phi 60 \times 10$ t Bk-7 glass after they had been respectively mounted on Spherical lens grinding machine under conditions of 2 kgw, 300 rpm, and soluble type polishing liquid diluted by 40 times for 15 minutes. As a result, the tool according to the present invention displayed the grindability of 4 μ/sec, but the comparative example displayed 0.8 μ/sec.

As described above, and according to the present invention, a uniform small piece of abrasive article in which diamond powder or cubic boron nitride pieces of abrasive articles are dispersed in metal and uniform and completely sintered piece of abrasive articles which does not display extremely reduced particle size distribution and which is obtained from completely sintering the former can be obtained. Then, it is dispersed and solidified in resin, metal, or glass having a low melting point. As a result, the obtained composite abrasive-articles can be freely controlled in its grinding ratio and grinding performance. Furthermore, the controllable grinding ratio and grinding resistance displays a significant improvement with respect to conventional abrasive-articles. Therefore, the most suitable grinding work can be conducted to correspond to the types of the material to be ground (material to be ground or material to be cut) and the grinding conditions. As a result, working efficiency can be improved. Furthermore, a pulverization process can be eliminated from the manufacturing processes for the composite abrasive-articles regardless of the fact whether the sintering is complete or incomplete. A free and optional selection of type of metal can be conducted. Furthermore, since the composite abrasive-articles is formed by completely sintered piece of abrasive articles which can be perfectly used without involving the portion left from the screening work, the manufacturing yield can be improved and thereby the manufacturing processes can be reduced so that cheap composite abrasive-articles can be manufactured.

What is claimed is:

1. A method of manufacturing composite abrasive-articles comprising the following steps of:

mixing diamond abrasive or cubic boron nitride abrasive and metal powder;

molding the mixture into a uniform small piece of abrasive articles;

then or simultaneously with said molding, completely sintering said uniform small piece of abrasive articles which has been molded; and mixing a completely sintered piece of abrasive articles which has been sintered and any of resin, metal, or glass having a low melting point, whereby the mixture is solidified into a predetermined shape.

2. A method of manufacturing a composite abrasive-articles according to claim 1, wherein the molding of said uniform small piece of abrasive-articles is in accordance with a screen printing method.

3. A method of manufacturing a composite abrasive-articles according to claim 1, wherein the molding of said uniform small piece of abrasive-articles is in accordance with a perforated screen printing method.

4. A method of manufacturing a composite abrasive-articles according to claim 1, wherein the molding of said uniform small piece of abrasive-articles is in accordance with a metal molding method.

5. A method of manufacturing a composite abrasive-articles according to claim 1, wherein the molding of said uniform small piece of abrasive-articles is in accordance with a hot pressing method.

6. A method of manufacturing a composite abrasive-articles according to claim 1, wherein the molding of said uniform small piece of abrasive-articles is in accordance with a molding method.

7. A method of manufacturing a composite abrasive-articles according to claim 1, wherein the molding of said uniform small piece of abrasive-articles is in accordance with a granulating method.

* * * * *